US008911170B1

(12) United States Patent
Daniel

(10) Patent No.: US 8,911,170 B1
(45) Date of Patent: Dec. 16, 2014

(54) BACK CREAM THERAPY DISPENSER

(76) Inventor: Isaac S. Daniel, Miramar, FL (US)

( * ) Notice: Subject to any disclaimer, the term of this patent is extended or adjusted under 35 U.S.C. 154(b) by 337 days.

(21) Appl. No.: 13/011,444

(22) Filed: Jan. 21, 2011

(51) Int. Cl.
*A45D 34/04* (2006.01)

(52) U.S. Cl.
CPC ..... *A45D 34/04* (2013.01); *A45D 2200/1081* (2013.01)
USPC ..... 401/162; 401/265

(58) Field of Classification Search
USPC ..... 401/8, 138, 143, 145, 152, 156, 158, 401/162, 163, 166, 168, 196, 205, 206, 159, 401/160, 161; 222/98, 101, 210, 281
See application file for complete search history.

(56) References Cited

U.S. PATENT DOCUMENTS

| | | | | |
|---|---|---|---|---|
| 5,240,339 | A * | 8/1993 | DeForest et al. | 401/207 |
| 5,931,590 | A * | 8/1999 | Harris | 401/6 |
| 6,129,469 | A * | 10/2000 | Messer et al. | 401/6 |
| 6,250,833 | B1 * | 6/2001 | Perry et al. | 401/278 |
| 6,412,997 | B2 * | 7/2002 | Berke et al. | 401/6 |
| 6,983,866 | B2 * | 1/2006 | Smart et al. | 222/192 |
| 7,040,830 | B2 * | 5/2006 | Kliegman et al. | 401/290 |
| 7,431,525 | B2 * | 10/2008 | Anderson | 401/188 R |
| 2004/0140326 | A1 * | 7/2004 | Smart et al. | 222/192 |
| 2004/0265042 | A1 * | 12/2004 | Chan et al. | 401/270 |
| 2005/0199651 | A1 * | 9/2005 | Laflamme et al. | 222/107 |
| 2006/0008313 | A1 * | 1/2006 | Wisniewski | 401/6 |
| 2007/0127980 | A1 * | 6/2007 | Tamez | 401/197 |
| 2008/0003048 | A1 * | 1/2008 | Glassman et al. | 401/163 |
| 2009/0003917 | A1 * | 1/2009 | Duncan | 401/6 |
| 2009/0092435 | A1 * | 4/2009 | Stevens | 401/6 |
| 2009/0129848 | A1 * | 5/2009 | Tatarsky et al. | 401/6 |

* cited by examiner

*Primary Examiner* — David Walczak
*Assistant Examiner* — Joshua Wiljanen
(74) *Attorney, Agent, or Firm* — Carol N. Green, Esq.

(57) ABSTRACT

An apparatus for dispensing cream comprising of an arm having a plurality of apertures disposed along a length of the arm spanning a substantial region at the distal end of the arm, wherein the plurality of apertures are adapted to flow the cream; a reservoir, positioned within walls of an outer member of the apparatus at the arm's proximal end, wherein the reservoir is adapted for receiving either the cream or a tube; and a press bar, positioned on the exterior walls of the apparatus, that is adapted to urge against the cream or tube located within the reservoir to flow through the plurality of apertures.

30 Claims, 5 Drawing Sheets

BACK CREAM THERAPY DISPENSER

FIELD OF THE INVENTION

The present disclosure relates generally to a system and method, and more particularly to an apparatus for dispensing cream therapy in hard to reach body parts, e.g. the back, ankles, foot soles and the like.

BACKGROUND OF THE INVENTION

Back pains can be significant and debilitating, affecting our ability to walk, stand and support our structure. Massage therapy has been known to alleviate back pains so long as the cause is not systemic. Other therapies may include applying topical medicated creams and or other types of muscle relaxants to the affected area. However, most adults are not flexible enough to reach certain areas of their backs, ankles, foot soles and the like to apply the topical medicated creams. Solutions for this problem would include having someone else apply the cream to those hard to reach places. Except, many adults are single or their children, spouses or other care givers may not be available to apply the same. As such, there needs to be an apparatus capable of reaching the hard to reach areas to dispense cream therapy for those hard to reach external body parts, e.g. the back, ankles and the like.

Accordingly, the various embodiments and disclosures described herein satisfies these long felt needs and solves the limitations of the prior art in a new and novel manner.

SUMMARY OF THE INVENTION

An objective of the invention is to provide an apparatus capable of dispensing cream therapy to hard to reach body parts.

Another object of the invention is to provide an apparatus for which cream or a tube can be stored in a reservoir within the apparatus for ready dispensation of cream therapy.

Another objective of the apparatus is to provide for the even distribution of cream therapy to hard to reach body parts with any dispensing of the cream.

The present invention provides for an apparatus for dispensing cream comprising of an arm having a plurality of apertures disposed along a length of the arm spanning a substantial region at the distal end of the arm, wherein the plurality of apertures are adapted to flow the cream; a reservoir, positioned within walls of an outer member of the apparatus at the arm's proximal end, wherein the reservoir is adapted for receiving either the cream or a tube; and a press bar, positioned on the exterior walls of the apparatus, that is adapted to urge against the cream or tube located within the reservoir to flow through the plurality of apertures. This allows for the reservoir to be replenished with a tube or directly with cream.

In an alternate embodiment, apparatus for dispensing cream comprises of an arm having a tubular member generally removably coupled at the distal end of the arm, wherein the tubular member includes a plurality of apertures arranged along the length of the tubular member, which spans a substantial region of the arm, and wherein the plurality of apertures are adapted to flow the cream; a reservoir, positioned within walls of an outer member of the apparatus at the arm's proximal end, wherein the reservoir is adapted for receiving either the cream or a tube; and a press bar, positioned on the exterior walls of the outer member of the apparatus, that is adapted to urge against the cream or tube located within the reservoir to flow through the plurality of apertures when pressed.

The present invention also includes a method for dispensing cream comprising the steps of: positioning an apparatus having arm which includes a plurality of apertures disposed along a length of the arm spanning a substantial region at the distal end of the apparatus, wherein the apertures are adapted to flow the cream; regulating a pressure of the cream pursuant to pressure applied to a press bar; introducing the cream from a reservoir positioned within the proximal end of the arm; and channeling the cream to the distal portion of the apparatus for the cream to flow through the plurality of apertures.

Additional objectives of the present invention will appear as the description proceeds.

The foregoing and other objects and advantages will appear from the description to follow. In the description, references are made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

Further objectives and advantages of the apparatus and method may be derived by referring to the detailed description and claims when considered in connection with the Figures, wherein like reference numbers refer to similar items throughout the Figures.

DETAILED DESCRIPTION OF THE PREFERRED EMBODIMENT

Figure 1:
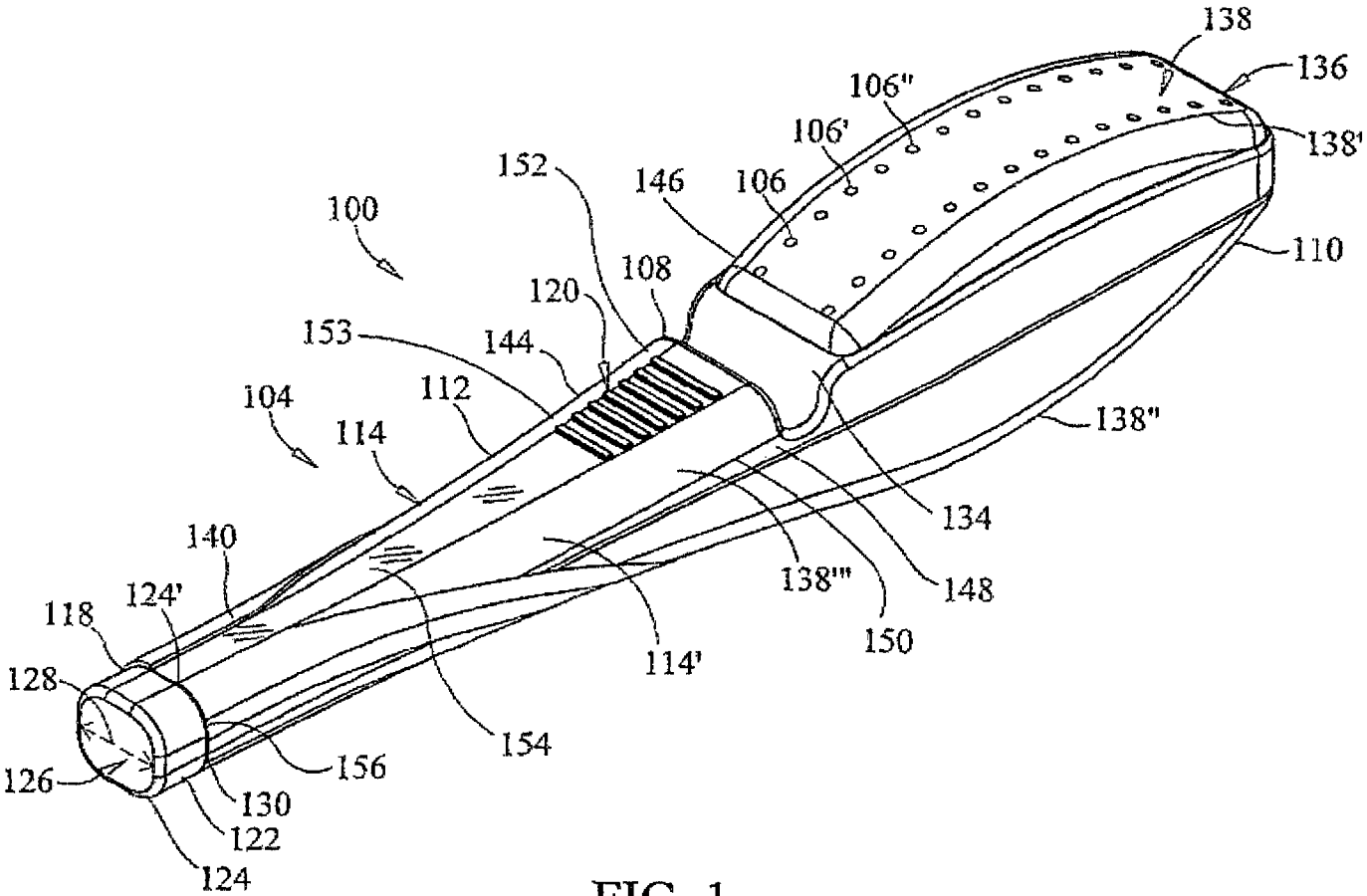
FIG. 1 shows an apparatus in accordance with one embodiment of the invention.

The following discussion describes in detail, varied embodiments of the apparatus 100 and method disclosed herein. However, this discussion should not be construed, as limiting the invention to those particular embodiments, as practitioners skilled in the art will appreciate that the apparatus 100 may vary as to configuration and as to details of the parts, and that a method may vary as to the specific steps and sequence, without departing from the basic concepts as disclosed herein. Similarly, the elements described herein may be implemented separately, or in various combinations without departing from the teachings of the present invention. Turning now descriptively to the drawings, in which similar reference characters denote similar elements throughout the various views.

FIG. 1 shows an apparatus 100 in accordance with one embodiment of the invention. Apparatus 100 for dispensing cream 102 comprises of an arm 104 having a plurality of apertures 106, 106', 106" disposed along a length 108 of the arm 104 spanning a substantial region at the distal end 110 of the arm 104, wherein the plurality of apertures 106, 106', 106" are adapted to flow the cream 102; a reservoir 112, positioned within the walls 114, 114' of an outer member 116 of the apparatus 100 at the arm's proximal end 118, wherein the reservoir 112 is adapted for receiving either the cream 102 or a tube; and a press bar 120, positioned on the exterior walls 114, 114' of the outer member 116 of the apparatus 100, that is adapted to urge against the cream 102 or tube located within the reservoir 112 to flow through the plurality of apertures 106, 106', 106". In some embodiments, the apparatus 100 includes a removable cap 122, wherein the removable cap 122 is detachably affixed to the proximal end 118 of the arm 104. This allows for the reservoir 112 to be replenished with a tube or directly with cream 102.

Apparatus 100 may be constructed in part or wholly from any material including but not limited to: plastic, cardboard, wood, metal, rubber, leather, silicone, cork, felt, fabric, neoprene, glass, or fiberglass, or other synthetic materials like polymers and the like. Notwithstanding the foregoing, the arm 104 remains firm while an individual uses the apparatus 100 to dispense cream therapy to his/her body parts. In some embodiments, the arm 104 is detachably attached to a removable cap 122 providing for the reservoir 112, positioned within the walls 114, 114' of an outer member 116 of the apparatus 100, to be replenished directly with the cream 102 or a tube containing the cream 102. In some embodiments, the arm 104 is adapted for a tube to be insertable within the reservoir 112 of the apparatus 100 for dispensing cream therapy.

The removable cap 122 may be constructed in part or wholly from any material including but not limited to: plastic, cardboard, wood, metal, rubber, leather, silicone, cork, felt, fabric, neoprene, glass, or fiberglass, or other synthetic materials like polymers and the like. Removable cap 122 at its base 124 may be configured to have a smooth, flat surface 126 in any shape such that the apparatus 100 may stand uprightly on its proximal end 118 resting on the removable cap's base 124. Such shapes may include but is not limited to: round, oval, square, rectangle, rhombus, diamond, triangle, oblong, hexagon, octagon, polygon, pentagon, hexagon, trapezoid, star or any other mathematical shape that is known and used in the arts. In some embodiments, removable cap 122 may be configured to include a smaller diameter 128 at its tip 130, which is positioned at the opposing end of its base 124, such that the removable cap 122 may snap into the base 124' of the arm 104 where they connect. In some embodiments, removable cap 122 includes securing means 132 for removably attaching the cap 122 to the arm 104. Securing means 132 may comprise of any one or more of the following: a buckle, hooks, loops, a hooks-and-loops, fastener, a clip, a zipper, glue, sticky tape, sticky tack, snaps, a plurality of monofilament hooks in cooperation with a plurality of monofilament loops, at least one magnet, threads, or any other means of fastening one object to another as are known and used in the arts.

The plurality of apertures 106, 106', 106" is spaced along the length of the arm 104 in any one or more of the following manner: equally distant, randomly placed, clusters, ordered arrangement or in any other formation as used in the arts. Apertures 106, 106', 106" may be configured in uniform sizes, e.g. extra small, small, medium, large, or extra large apertures 106, 106', 106" solely, or in any combination thereof, along the length 108 of the arm 104. The plurality of apertures 106, 106', 106" spans a substantial region at the distal end 110 of the apparatus 100, such that when the cream 102 is dispensed it covers a significant surface area of a body part.

In some embodiments, the arm's distal end 110, where the cream 102 is dispensed, includes an underside 134 adapted with material 136 for making smooth contact with a body part. Such material 136 may comprise of any one or more of the following: fabric (e.g. velvet, cotton, felt, wool, chamois and the like), neoprene, and/or microfibers. In some embodiments, the underside 134 is contoured with rounded edges 138, 138' for making smooth contact with a body part. In some embodiments, the walls 114, 114' of an outer member 116 of the apparatus 100 is also contoured with rounded edges 138", 138'", e.g. at the arm's proximal end 118 as shown in FIG. 1.

In some embodiments, apparatus 100 comprises at least one hand grip element 140, wherein the at least one hand grip element 140 is securely affixed to the arm 104 of the apparatus 100. The at least one hand grip element 140 may be formed in part of a material selected from the group comprising of: fabric, elastic, leather, plastic, polymers, rubber, silicone, metal, padding, cushion, foam, synthetic fabric, neoprene, anti-slip fabric, anti-slide fabric, insulation and the like.

In some embodiments, the at least one hand grip element 140 connects and extends from the apparatus' arm 104, wherein the at least one hand grip element 140 is configured to be grasped by an individual, and further configured to retain the individual's hands in an immovable position when the apparatus 100 is in use. Such hand grip element 140 may include at least one aperture 142 configured for the individual's hands to be insertable into the at least one aperture 142. In some embodiments, the at least one hand grip element 140 is elasticized and stretchable.

Figure 2:
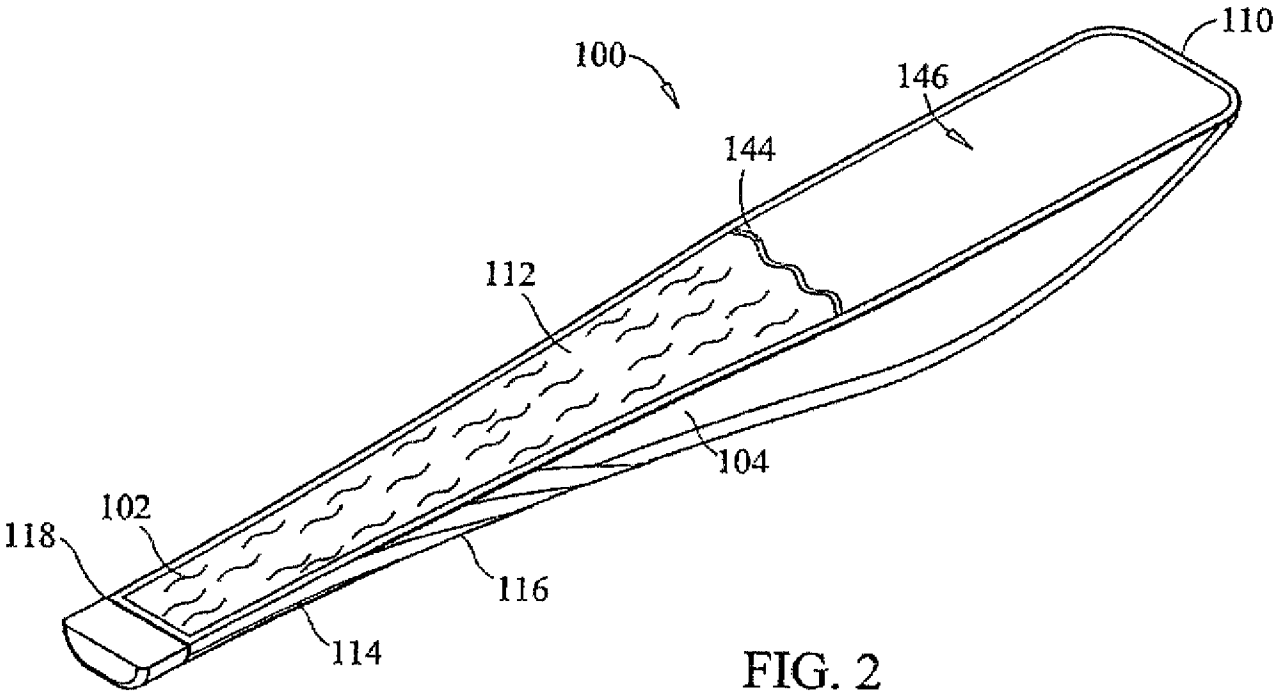
FIG. 2 shows a cut away view of the apparatus in accordance with one embodiment of the invention.

FIG. 2 shows a cut away view of the apparatus 100 in accordance with one embodiment of the invention. Apparatus 100 includes a reservoir 112, positioned within the walls 114, 114' of an outer member 116 of the apparatus 100 at the arm's proximal end 118, adapted for receiving either the cream 102 or a tube containing the cream 102, wherein the tube or cream 102 may be insertable therein. The reservoir 112 is formed by the hollow created by the walls 114, 114' of an outer member 116 of the apparatus 100 at the arm's proximal end 118 encompassing a substantial surface area within the walls 114, 114' of an outer member 116 of the apparatus 100 at the arm's proximal end 118.

The cream 102 within the reservoir 112 is dispensed at the distal end 110 of the apparatus's arm 104. In some embodiments, cream 102 may include medicated ointment having therapeutic properties for treating muscle spasms, aches and pains. In some embodiments, apparatus 100 may be used instead to dispense moisturizing cream therapy for lubricating the body part being treated. Nonetheless, as the cream 102 is dispensed through the plurality of apertures 106, 106', 106", the cream 102 is substantially homogeneous, i.e. not varied in concentration or structure.

Arm 104 includes a press bar 120, positioned on the exterior walls 114, 114' of the outer member 116 of the apparatus 100. One skilled in the art would recognize that the press bar 120 can be located on any surface of the arm 104. As shown, the press bar 120 is located on the underside 134 of the apparatus' arm 104. Press bar 120 is configured to receive a thumb or any other parts of the hand and is adapted to urge against the cream or tube located within the reservoir 112 to flow through the plurality of apertures 106, 106', 106". Press bar 120 is coupled to a flow control means 144, e.g. a pressure valve or pump, that is positioned within the inner walls 114, 114' of the outer member 116 of the arm 104, wherein the flow control means 144 controls the flow of the cream through the plurality of apertures 106, 106', 106".

In some embodiments, the flow control means 144 comprises of a pump that is positioned within the reservoir 112, which generally pumps the cream 102 from the reservoir 112 to the apparatus' head 146 positioned at the distal end 110 of the arm 104. As such, the cream 102 flows from the reservoir 112 to the head 146 and through the plurality of apertures 106, 106', 106" where it is dispensed as cream therapy. In some embodiments, flow control means 144 could be any kind of pump that is known and used in the arts, for example a pump having a spring loaded piston 148, which further includes a ratcheting system 150 to allow the piston 148 to move incrementally. Thus, when the press bar 120 is depressed it releases for example a latch 152 that holds the piston 148 in place with the ratchet 153. In this manner, the cream 102 is dispensed incrementally.

Additionally, the process of adjusting the flow through the plurality of apertures 106, 106', 106" may occur iteratively over the course of a therapy session to dynamically control the rate of dispensing cream at any time. For example, the press bar 120 may be engaged causing the dispensing of the cream 102. However, the area being treated may exceed the volume of cream 102 released through the plurality of apertures 106, 106', 106". Accordingly, the individual may need to re-engage the press bar 120 one or more times to adequately cover the treated area.

In some embodiments, apparatus 100 may include a clear window 154 on an exterior wall 114 of the outer member 116 for viewing the levels of available cream 102 remaining. In this manner, the user can monitor the levels of cream 102 available and/or remaining for the desired cream therapy. In some embodiments, apparatus 100 includes at least one sensor 156 to monitor the level of cream 102 available and/or remaining.

Figure 3:
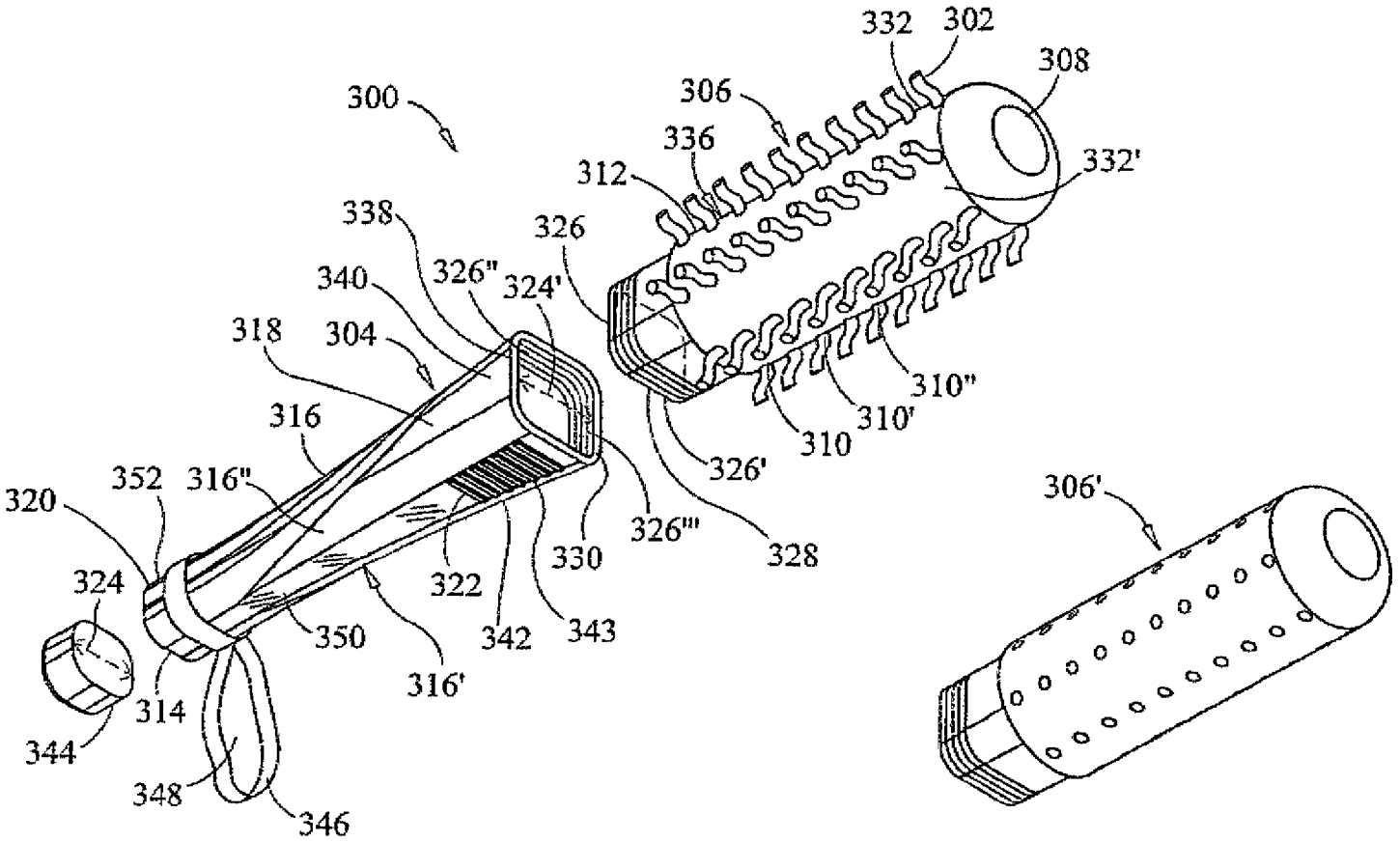
FIG. 3 shows an apparatus in accordance with another embodiment of the invention.

FIG. 3 shows an apparatus 300 in accordance with another embodiment of the invention. In some embodiments, apparatus 300 for dispensing cream 302 comprises of an arm 304 having a tubular member 306 generally removably coupled at the distal end 308 of the arm 304, wherein the tubular member 306 includes a plurality of apertures 310, 310', 310" arranged along the length 312 of the tubular member 306, which spans a substantial region of the arm 304, and wherein the plurality of apertures 310, 310', 310" are adapted to flow the cream 302; a reservoir 314, positioned within walls 316, 316' of an outer member 318 of the apparatus 300 at the arm's proximal end 320, wherein the reservoir 314 is adapted for receiving either the cream 302 or a tube; and a press bar 322, positioned on the exterior walls 316, 316' of the outer member 318 of the apparatus 300, that is adapted to urge against the cream 302 or tube located within the reservoir 314 to flow through the plurality of apertures 310, 310', 310" when pressed.

Apparatus 300 may be constructed in part or wholly from any material including but not limited to: plastic, cardboard, wood, metal, rubber, leather, silicone, cork, felt, fabric, neoprene, glass, or fiberglass, or other synthetic materials like polymers and the like. Notwithstanding the foregoing, the arm 304 remains firm while an individual uses the apparatus 300 to dispense cream therapy to his/her body parts.

The at least one tubular member 306 at the distal end 308 of the arm 304 includes a plurality of apertures 310, 310', 310" arranged along the length 312 of the tubular member 306 spanning a substantial region, wherein the apertures 310, 310', 310" are adapted to flow the cream 302. The at least one tubular member 306 is cylindrical and may be constructed in part or wholly from any material including but not limited to: plastic, cardboard, wood, metal, rubber, leather, silicone, cork, felt, fabric, neoprene, glass, or fiberglass, or other synthetic materials like polymers and the like. Generally, the at least one tubular member 306 is hollow for the receipt of the cream 302 so that the cream 302 may be dispensed through the plurality of apertures 310, 310', 310". This allows the tubular member 306 to be easily cleaned and/or sanitized when the apparatus 300 is not in use, thereby providing for multiples uses and a plurality of users.

In some embodiments, the at least one tubular member 306 is removably coupled to the arm 304 providing for easy removal and replacement with for example, another tubular member 306' for use by another individual. In some embodiments, the tubular member 306 is coupled to the arm 304 by a snap connection, whereby the tubular member 306 having a diameter 324 either smaller or larger than the diameter 324' of the arm 304 such that it may be snapped into the arm 304 of the apparatus 300 or vice versa where the arm 304 may snap into the tubular member 306 at the point of their connection. In some embodiments, tubular member 306 includes securing means 326, for securing it to the arm 304. Securing means 326 may comprise of any one or more of the following: a buckle, hooks, loops, a hooks-and-loops, fastener, button, buttonhole, a clip, a zipper, glue, sticky tape, sticky tack, snaps, a plurality of monofilament hooks in cooperation with a plurality of monofilament loops, at least one magnet, threads, or any other means of fastening one object to another as are known and used in the arts.

In an exemplary embodiment, tubular member 306 includes threads 326, 326' located at its base's exterior 328 for cooperating with corresponding threads 326", 326'" positioned on the interior walls 316 of the arm 304 disposed at the point of interface 330 with the at least one tubular member 306. In this manner, the tubular member 306 may be removably coupled to the arm 304 by the cooperating threads 326, 326', 326", 326". The removability of the tubular member 306 allows different family members to remove and replace the tubular member 306 with another tubular member 306' for their own use.

The plurality of apertures 310, 310', 310", are spaced along the length of the tubular member 306 in any one or more of the following manner: equally distant, randomly placed, clusters, ordered arrangement or in any other formation as used in the arts. In some embodiments the at least one tubular member 306 is cylindrical with the plurality of apertures 310, 310', 310", substantially surrounding the surface area of the at least one tubular member 306 as shown in FIG. 3. The plurality of apertures 310, 310', 310" may be configured in a uniform size, or may comprise of extra small, small, medium, large, or extra large apertures 310, 310', 310" solely or in any combination thereof. The plurality of apertures 310, 310', 310" span a substantial region at the distal end 308 of the tubular member 306, such that when the cream 302 is dispensed it covers a significant surface area of a body part. In some embodiments, the tubular member 306 is contoured in part or wholly with rounded edges 332, 332' making smooth contact with a body part. The cream 302 may be replenished by detaching the tubular member 306 from the arm 304 and replenishing the apparatus 300 directly with the cream 302 or a tube of cream 302, which is stored in the reservoir 314.

Additionally, the process of adjusting the flow through the plurality of apertures 310, 310', 310" may occur iteratively over the course of a therapy session to dynamically control the rate of dispensing cream 302 at any time. For example, the press bar 322 may be engaged causing the dispensing of the cream 302. However, the area being treated may exceed the volume of cream 302 released through the plurality of apertures 310, 310', 310". Accordingly, the individual may need to re-engage the press bar 322 one or more times to adequately cover the treated area.

Arm 304 includes a press bar 322, positioned on the exterior walls 316, 316" of the outer member 318 of the apparatus 300. One skilled in the art would recognize that the press bar 322 can be located on any surface of the arm 304. Press bar 322 is configured to receive a thumb or any other parts of the hand and is adapted to urge against the cream or tube located within the reservoir 314 to flow through the plurality of apertures 310, 310', 310". Press bar 322 is coupled to flow control means 336, e.g. a pressure valve or pump, that is positioned within the inner walls 316, 316" of the outer member 318 of the arm 304, wherein the flow control means 336 controls the flow of the cream 302 through the plurality of apertures 310, 310', 310", 310,' 310."

In some embodiments, the flow control means 336 comprises of a pump positioned within the reservoir 314, which generally pumps the cream 304 from the reservoir 314 to the apparatus' head 336 positioned at the distal end 308 of the arm 304. As such, the cream 304 flows from the reservoir 314 to the head 336 and through the plurality of apertures 310, 310', 310" where it is dispensed as cream therapy. In some embodiments, flow control means 336 could be any kind of pump that is known and used in the arts, for example a pump having a spring loaded piston 338, which further includes a ratcheting system 340 to allow the piston 338 to move incrementally. Thus, when the press bar 322 is depressed it releases for example a latch 342 that holds the piston in place with the ratchet 343. In this manner, the cream 304 is dispensed incrementally from the reservoir 314.

Reservoir 314, positioned within the walls 316, 316' of an outer member 318 of the apparatus 300 at the arm's proximal end 320, is adapted for receiving either the cream 302 or a tube containing the cream 302, wherein the tube or cream 302 may be insertable within.

Reservoir 314 is formed by the hollow created by the walls 316, 316' of an outer member 318 of the apparatus 300 at the arm's proximal end 320. In some embodiments, the reservoir 314 may be small, medium or large encompassing a substantial surface area within the walls 316, 316' of an outer member 318 of the apparatus 300 at the arm's proximal end 320. Reservoir 314 is adapted for receiving either the cream 302 or a tube of cream 302 for dispensing cream therapy in hard to reach areas.

The cream 302 contained in the reservoir 314 is dispensed at the distal end 308 of the apparatus 300. The cream 302 may include medicated ointment having therapeutic properties for treating muscle spasms, aches and pains. In some embodiments, apparatus 300 may be used to dispense moisturizing cream therapy for lubricating the body part being treated. As the cream 302 flows through the plurality of apertures 310, 310', 310", the cream 302 is substantially homogeneous, i.e. not varied in concentration or structure.

In some embodiments, apparatus 300 includes a removable cap 344, wherein the removable cap 344 is detachably affixed to the proximal end 320 of the arm 304. Removable caps provides for an alternate access to the reservoir 322 that is positioned within the walls 316, 316' of an outer member 318 of the apparatus 300, such that the cream 302 may be replenished for dispensing cream therapy. Such removable cap 122 is constructed and configured in the same manner as described more fully in conjunction with FIGS. 1 & 2.

In some embodiments, apparatus 300 further comprises of at least one hand grip element 346, wherein the at least one hand grip element 346 is securely affixed to the arm 304 of the apparatus 300. The at least one hand grip element 346 may be formed in part of a material selected from the group comprising of: fabric, wool, elastic, leather, plastic, polymers, rubber, silicone, metal, padding, cushion, foam, synthetic fabric, neoprene, anti-slip fabric, anti-slide fabric, insulation.

In some embodiments, the at least one hand grip element 346 connects and extends from the apparatus' arm 304, wherein the at least one hand grip element 346 is configured to be grasped by an individual, and further configured to retain the individual's hands in an immovable position when the apparatus 300 is in use. Such hand grip element 346 may include at least one aperture 348 configured for the individual's hands to be insertable into the at least one aperture 348. In some embodiments, the at least one hand grip element 346 is elasticized and stretchable.

In some embodiments, apparatus 300 may include a clear window 348 (not shown) on the exterior wall 316 of the arm 304 for viewing the levels of available cream 302 remaining. In this manner, a user of the apparatus 300 can monitor the levels of cream 302 available and/or remaining for the desired cream therapy. In some embodiments, apparatus 300 includes at least one sensor 348 (not shown) to monitor the level of cream 302 available and/or remaining.

Figure 4:
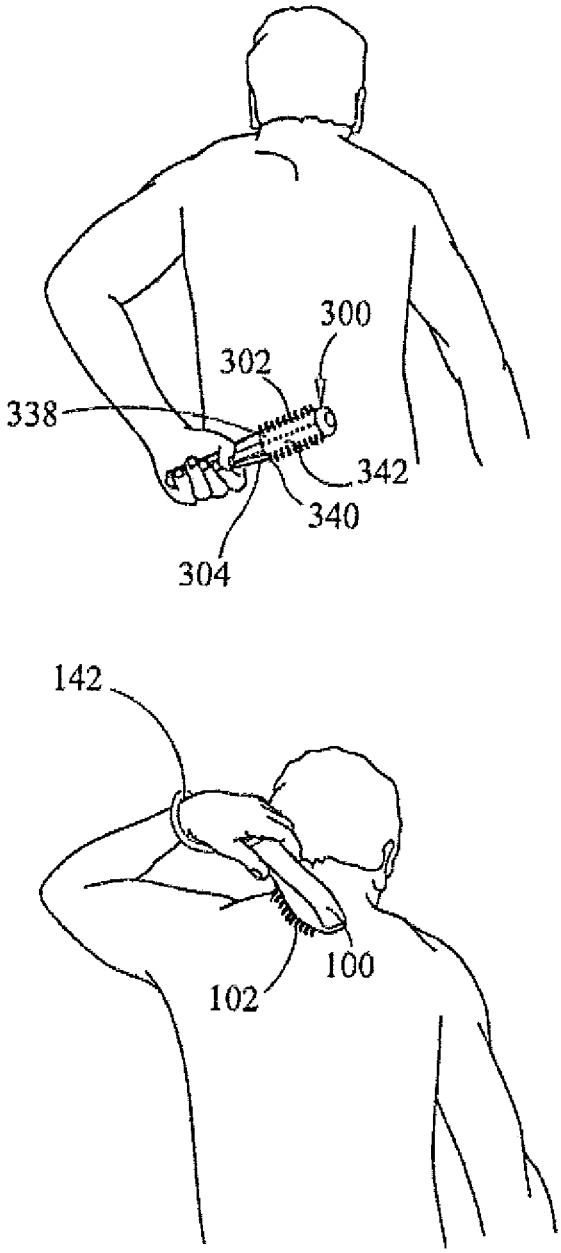
FIG. 4 illustrates the apparatus in use in accordance with embodiments of the invention.

FIG. 4 illustrates the apparatus 100, 300 in use in accordance with different embodiments of the invention. As shown, an individual may grasp the hand grip element 140, 346 and extend their arm to hard to reach places like the middle of one's back, where the apparatus 100, 300 operates like an extension of the user's arm. As previously described in conjunction with FIGS. 1-3, once the press bar 120, 322 has been depressed it engages the flow control means 144, 336 positioned within the apparatus 100, 300 to dispense the cream 102, 304 contained within the reservoir 112, 314.

METHODS

Figure 5:
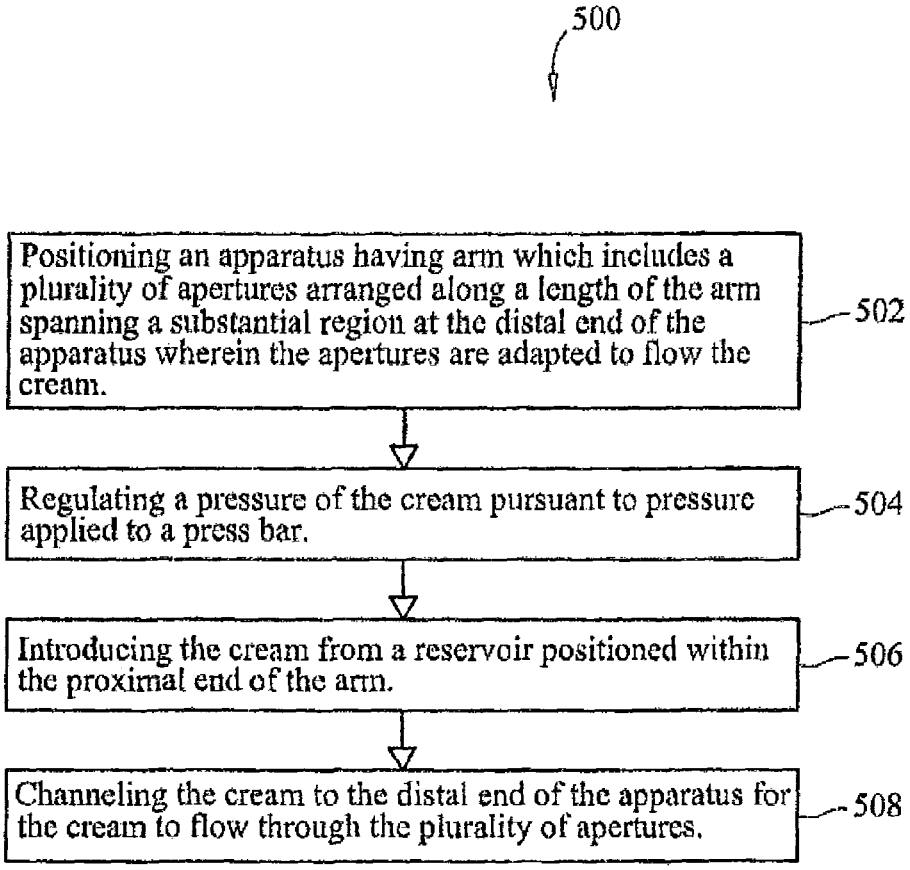
FIG. 5 is a sample flowchart of an exemplary method of dispensing cream therapy in accordance with one embodiment.

FIG. 5 is a sample flowchart of an exemplary detailed method 500 of dispensing cream therapy in accordance with one embodiment. Method 500 for dispensing cream 102, 302 comprises the steps of positioning an apparatus 100, 300 having arm 104, 304, which includes a plurality of apertures 106, 106', 310, 310' arranged along a length 108, 312 of the arm 104, 304 spanning a substantial region at the distal end 110, 308 of the apparatus 100, 300 wherein the apertures 106, 106', 310, 310' are adapted to flow the cream 102, 302 (step 502). Apparatus 100, 300 as used herein includes an arm 104, 304 a reservoir 106, 314 and press bar 120, 322 as described more fully in FIGS. 1 through 4 and are incorporated herein by reference as though fully stated herein. In some embodiments, apparatus 100, 300 includes a tubular member 304 as described more fully in FIG. 3, as well as a removable cap 106 as more fully described in FIGS. 1 through 4 and are incorporated herein by reference as if fully stated herein.

Apparatus 100, 300 may be constructed in part or wholly from any material including but not limited to: plastic, cardboard, wood, metal, rubber, silicone, cork, felt, fabric, neoprene, plastic polymers, glass, or fiberglass, or other synthetic materials like polymers and the like. Notwithstanding the foregoing, the arm 104, 304 remains firm while a user uses the apparatus 100, 300 to dispense cream therapy to his/her body parts.

The plurality of apertures 106, 106', 310, 310' is spaced along the length of the arm 104 or along the at least one tubular member 306 in any one or more of the following manner: equally distant, randomly placed, clusters, ordered arrangement or in any other formation as used in the arts. Apertures 106, 106', 310, 310' may be configured in uniform sizes, e.g. extra small, small, medium, large, or extra large apertures 106, 106', 310, 310' solely, or in any combination thereof, along the length 108 of the arm 104 or the tubular member 306. The plurality of apertures 106, 106', 310, 310' spans a substantial region at the distal end 110, 308 of the apparatus 100, 300, such that when the cream 102, 302 is dispensed it covers a significant surface area of a body part.

Method 500 further comprises regulating a pressure of the cream 102, 302 pursuant to pressure applied to a press bar 120, 322 (step 504). The cream 102, 302 contained in the reservoir 112, 314 is dispensed at the distal end 110, 308 of the apparatus 100, 300. The cream 102, 302 may include medicated ointment having therapeutic properties for treating muscle spasms, aches and pains. Press bar 120, 322 is positioned on the exterior walls 114, 114', 316, 316' of the outer member 116, 318 of the apparatus 100, 300. One skilled in the art would recognize that the press bar 120, 322 can be located on any surface of the arm 104, 304. Press bar 120, 322 is configured to receive a thumb or any other parts of the hand and is adapted to urge against the cream 102, 302 or tube located within the reservoir 112, 314 to flow through the plurality of apertures 106, 106', 310, 310'. Press bar 120, 322 is coupled to flow control means 144, 334 as more fully described in conjunction with FIGS. 1-4, where the flow control means 144, 334 is positioned within the inner walls 114, 114', 316, 316' of the outer member 116, 318 of the arm 104, 304 controlling the flow of the cream 102, 302 through the plurality of apertures 106, 106', 310, 310'.

Method 500 also comprises of introducing the cream from a reservoir 112, 314 positioned within the proximal end 118, 320 of the arm 104, 304 (step 506). Reservoir 112, 314 is positioned within the walls 114, 114', 316, 316' of an outer member 116, 318 of the apparatus 100, 300 at the proximal end 118, 320 and is adapted for receiving either the cream 102, 302 or a tube containing the cream 102, 302 wherein the tube or cream 102, 302 may be insertable within. Reservoir 112, 314 generally encompasses a substantial area at the proximal end 118, 320 of the apparatus 100, 300 as outlined by the walls 114, 114', 316, 316' of an outer member 116, 318 of the apparatus 100, 300. In this manner, the apparatus 100, 300 may be refilled with cream 102, 302 or a tube containing cream 102, 302 to be dispensed. In some embodiments, within the reservoir 112 is a flow control means 144, 334, e.g. a pump, which generally pumps the cream 102, 302 from the reservoir 112, 314 through the head 146, 336 to the plurality of apertures 106, 106', 310, 310'.

Method 500 further comprises of channeling the cream 102, 302 to the distal end 110, 308 of the apparatus 100, 300 for the cream 102, 302 to flow through the plurality of apertures 106, 106', 310, 310' (step 508). As such, the cream 102, 302 once dispensed can make contact with the body part and the apparatus 100, 300 may be used to further distribute cream 102, 302 over the target area.

While certain novel features of this invention have been shown and described and are pointed out in the annexed claims, it is not intended to be limited to the details above, since it will be understood that various omissions, modifications, substitutions and changes in the forms, method, steps and system illustrated and in its operation can be made by those skilled in the art without departing in any way from the spirit of the present invention.

What is claimed is:

1. An apparatus for dispensing cream comprising:

(a) an arm, directly connected to a reservoir, having a plurality of apertures disposed along a length of the arm spanning a substantial region at the distal end of the arm, wherein the cream flows through the plurality of apertures when a press bar is engaged;

(b) the reservoir is positioned within walls of an outer member of the apparatus at the arm's proximal end, and is disposed for receiving and retaining either the cream or a tube;

(c) a clear window disposed on the exterior wall of the outer member;

d) the press bar, positioned on the exterior walls of the outer member of the apparatus, includes ridges for engaging a flow control means, positioned within the inner walls of the outer member of the arm, which is coupled to the press bar; and (e) the flow control means includes a pressure valve or pump for automatically controlling the flow of the cream, when the press bar is urged against the cream or tube located within the reservoir to flow through the plurality of apertures.

2. The apparatus of claim 1, wherein the apparatus includes a removable cap that is detachably affixed to the proximal end of the arm.

3. The apparatus of claim 1, wherein the apparatus may be constructed in part from any material including but not limited to: plastic, cardboard, wood, metal, rubber, leather, silicone, cork, felt, fabric, neoprene, glass, fiberglass or polymers.

4. The apparatus of claim 1, wherein the plurality of apertures are spaced along the length of the arm in any one or more of the following manner:

equally distant, randomly placed, clusters, or ordered arrangement.

5. The apparatus of claim 1, wherein the arm includes an underside contoured with rounded edges and includes material at the distal end.

6. The apparatus of claim 5, wherein the material may comprise of any one or more of the following: fabric, neoprene and microfibers.

7. The apparatus of claim 1, further comprising at least one hand grip element, wherein the at least one hand grip element is securely affixed to the arm of the apparatus.

8. The apparatus of claim 7, wherein the at least one hand grip element is formed in part of a material selected from the group comprising of: fabric, elastic, leather, plastic, polymers, rubber, silicone, metal, padding, cushion, foam, synthetic fabric, neoprene, anti-slip fabric, anti-slide fabric, and insulation.

9. The apparatus of claim 7, wherein the at least one hand grip element connects and extends from the arm that can be grasped by an individual, and further retain the individual's hands in an immovable position when the apparatus is in use.

10. The apparatus of claim 9, wherein the at least one hand grip element includes at least one aperture configured for the individual's hands to be insertable into the at least one aperture.

11. The apparatus of claim 7, wherein the at least one hand grip element is elasticized and stretchable.

12. The apparatus of claim 1, further comprising at least one sensor for monitoring the level of cream.

13. The apparatus of claim 1, wherein the flow control means controls the flow of the cream through the plurality of apertures.

14. The apparatus of claim 1, wherein the arm includes a reservoir for a tube to be insertable within.

15. An apparatus for dispensing cream comprising:

(a) an arm having a tubular member generally removably coupled at the distal end of the arm, wherein the tubular member includes a plurality of apertures arranged along a length of the tubular member, which spans a substantial region of the arm, and wherein the plurality of apertures are adapted to flow the cream;

(b) a reservoir positioned within walls of an outer member of the apparatus at the arm's proximal end, wherein said reservoir is disposed for receiving and retaining either the cream or a tube;

(c) at least one sensor disposed within said outer member for monitoring the level or quantity of cream;

(d) a clear window disposed on the exterior wall of the outer member; and (e) a press bar, positioned on the exterior walls of the outer member of the apparatus, includes ridges for engaging a flow control means, positioned within the inner walls of the outer member of the arm, which is coupled to a press bar, wherein said flow control means includes a pressure valve or pump for automatically controlling the flow of the cream, when the press bar is urged against the cream or tube located within the reservoir to flow through the plurality of apertures.

16. The apparatus of claim 15, wherein the apparatus may be constructed in part from any material including but not limited to: plastic, cardboard, wood, metal, rubber, leather, silicone, cork, felt, fabric, neoprene, glass, fiberglass or polymers.

17. The apparatus of claim 15, wherein the tubular member is connected to the arm by a snap connection.

18. The apparatus of claim 15, wherein the tubular member includes securing means which comprises of any one or more of the following: a buckle, hooks, loops, a hooks-and-loops, fastener, a clip, a zipper, glue, sticky tape, sticky tack, snaps, a plurality of monofilament hooks in cooperation with a plurality of monofilament loops, at least one magnet, or threads.

19. The apparatus of claim 15, wherein the arm includes threads positioned on the interior walls of the arm disposed at the point of interface with the at least one tubular member.

20. The apparatus of claim 15, wherein the plurality of apertures are spaced along the length of the at least one tubular member in any one or more of the following manner: equally distant, randomly placed, clusters or ordered arrangement.

21. The apparatus of claim 15, wherein the at least one tubular member is cylindrical with the plurality of apertures substantially surrounding the surface area of the at least one tubular member.

22. The apparatus of claim 15, further comprising at least one sensor for monitoring the level of cream.

23. The apparatus of claim 15, wherein the flow control means controls the flow of the cream through the plurality of apertures.

24. The apparatus of claim 15, wherein the arm includes a reservoir for a tube to be insertable within.

25. The apparatus of claim 15, further comprising of at least one hand grip element, wherein the at least one hand grip element is securely affixed to the arm of the apparatus.

26. The apparatus of claim 25, wherein the at least one hand grip element is formed in part of a material selected from the group comprising of: fabric, wool, elastic, leather, plastic, polymers, rubber, silicone, metal, padding, cushion, foam, synthetic fabric, neoprene, anti-slip fabric, anti-slide fabric, insulation.

27. The apparatus of claim 25, wherein the at least one hand grip element connects and extends from the arm, that can be grasped by an individual, and further configured to retain the individual's hands in an immovable position when the apparatus is in use.

28. The apparatus of claim 27, wherein the at least one hand grip element includes at least one aperture configured for the individual's hands to be insertable into the at least one aperture.

29. The apparatus of claim 25, wherein the at least one hand grip element is elasticized and stretchable.

30. The apparatus of claim 15, wherein the apparatus includes a removable cap is detachably affixed to the proximal end of the arm.

* * * * *